US009126749B2

(12) United States Patent
Hodges et al.

(10) Patent No.: US 9,126,749 B2
(45) Date of Patent: Sep. 8, 2015

(54) CONNECTORS FOR LINER-BASED DISPENSE CONTAINERS

(75) Inventors: Jordan Henery Hodges, Cedar Park, TX (US); Tom Johnson, Star Prairie, WI (US); Amy Koland, Eden Prairie, MN (US); Greg Nelson, Minneapolis, MN (US); Rick Wilson, Edina, MN (US); Don Ware, Woodbury, MN (US)

(73) Assignee: Advanced Technology Materials, Inc., Billerica, MA (US)

( * ) Notice: Subject to any disclaimer, the term of this patent is extended or adjusted under 35 U.S.C. 154(b) by 48 days.

(21) Appl. No.: 13/879,433

(22) PCT Filed: Oct. 14, 2011 (Under 37 CFR 1.47)

(86) PCT No.: PCT/US2011/056291

§ 371 (c)(1), (2), (4) Date: Apr. 15, 2013

(87) PCT Pub. No.: WO2012/051496

PCT Pub. Date: Apr. 19, 2012

(65) Prior Publication Data

US 2014/0001205 A1 Jan. 2, 2014

Related U.S. Application Data

(60) Provisional application No. 61/438,338, filed on Feb. 1, 2011, provisional application No. 61/393,583, filed on Oct. 15, 2010, provisional application No. 61/427,318, filed on Dec. 27, 2010.

(51) Int. Cl.

*B65D 35/28* (2006.01)
*B65D 83/62* (2006.01)

(Continued)

(52) U.S. Cl.

CPC ..... *B65D 83/62* (2013.01); *B65D 23/02* (2013.01); *B65D 77/06* (2013.01); *B65D 83/0055* (2013.01); *B67D 7/0261* (2013.01); *B67D 7/0294* (2013.01); *B65D 83/0061* (2013.01)

(58) Field of Classification Search

CPC ..... B65D 83/62; B65D 83/0061; B65D 83/0055; B65D 23/02; B65D 77/06; B67D 7/0261; B67D 7/0294

USPC ..... 222/1, 95, 105, 183, 386.5, 394, 399, 222/464.1, 396, 325

See application file for complete search history.

(56) References Cited

U.S. PATENT DOCUMENTS 4,187,959 A * 2/1980 Pelton ..... 222/94
5,031,801 A 7/1991 Osgar et al.

(Continued)

FOREIGN PATENT DOCUMENTS

EP 1097899 5/2001
EP 2388233 11/2011

(Continued)

OTHER PUBLICATIONS

U.S. Appl. No. 61/251,430, filed Oct. 14, 2009, Tom et al.

(Continued)

*Primary Examiner* — Frederick C Nicolas
(74) *Attorney, Agent, or Firm* — Christensen Fonder P.A.

(57) ABSTRACT

The present disclosure relates to novel and advantageous connector assemblies for use with a liner-based assembly. In one embodiment, a connector assembly for use with a liner-based assembly can include a pressure port, a dispense port, a headspace removal port, and a locking mechanism. The pressure port can be adapted for connection to a pressure source. The dispense port can be adapted for fluid communication with a source of material to be dispensed from the liner-based assembly. The headspace removal port may be configured for removing a gas from the liner-based assembly. The locking mechanism may be used for locking the connector to the liner-based assembly when contents therein are under pressure. In some embodiments, the dispense port and headspace removal port may be operably coupled providing a flow path for recirculation of the contents within a liner of the liner-based assembly.

19 Claims, 5 Drawing Sheets

(51) Int. Cl.

| | |
|---|---|
| ***B65D 23/02*** | (2006.01) |
| ***B65D 77/06*** | (2006.01) |
| ***B67D 7/02*** | (2010.01) |
| *B65D 83/00* | (2006.01) |

(56) References Cited

U.S. PATENT DOCUMENTS

| | | | | |
|---|---|---|---|---|
| 5,102,010 | A | 4/1992 | Osgar et al. | |
| 5,158,204 | A | 10/1992 | Martrich et al. | |
| 5,199,609 | A | 4/1993 | Ash, Jr. | |
| 5,213,232 | A | 5/1993 | Kraft et al. | |
| 5,230,447 | A | 7/1993 | Kirk | |
| 5,435,460 | A | 7/1995 | Osgar | |
| 5,693,017 | A | 12/1997 | Spears et al. | |
| 5,875,921 | A | 3/1999 | Osgar et al. | |
| 5,988,422 | A | 11/1999 | Vallot | |
| 6,015,068 | A | 1/2000 | Osgar et al. | |
| 6,206,240 | B1 | 3/2001 | Osgar et al. | |
| 6,237,809 | B1 * | 5/2001 | Kawai et al. | 222/95 |
| 6,453,925 | B1 | 9/2002 | Kamo | |
| 6,460,730 | B1 | 10/2002 | Liedtke | |
| 6,564,973 | B1 | 5/2003 | Brown et al. | |
| 6,848,599 | B2 | 2/2005 | Hammarth et al. | |
| 7,021,500 | B1 | 4/2006 | Finn et al. | |
| 7,025,234 | B2 | 4/2006 | Priebe et al. | |
| 7,316,329 | B2 | 1/2008 | Wertenberger | |
| 7,735,300 | B2 | 6/2010 | Outreman | |
| 8,733,598 | B2 * | 5/2014 | Nelson et al. | 222/386.5 |
| 2004/0149348 | A1 | 8/2004 | Wertenberger | |
| 2004/0188449 | A1 | 9/2004 | Thompson | |
| 2009/0020176 | A1 * | 1/2009 | Hasegawa et al. | 137/614.05 |
| 2009/0057347 | A1 | 3/2009 | Leys et al. | |
| 2010/0112815 | A1 | 5/2010 | O'Dougherty et al. | |
| 2010/0186352 | A1 | 7/2010 | Thomasset et al. | |

FOREIGN PATENT DOCUMENTS

| | | |
|---|---|---|
| JP | 06100087 | 4/1994 |
| JP | 2008007154 | 1/2008 |
| WO | 2005100203 | 10/2005 |
| WO | 2006133026 | 12/2006 |
| WO | 2007061967 | 5/2007 |
| WO | 2007146892 | 12/2007 |
| WO | 2008095024 | 8/2008 |
| WO | 2009076101 | 6/2009 |
| WO | 2011006146 | 1/2011 |
| WO | 2011046802 | 4/2011 |
| WO | 2011085012 | 7/2011 |
| WO | 2012051496 | 5/2012 |

OTHER PUBLICATIONS

U.S. Appl. No. 61/391,945, filed Oct. 11, 2010, Tom et al.
U.S. Appl. No. 61/405,567, filed Oct. 21, 2010, Tom et al.
International Search Report and Written Opinion for related PCT Application PCT/US2012/065515, mailed Feb. 11, 2013 (6 pp.).

* cited by examiner

CONNECTORS FOR LINER-BASED DISPENSE CONTAINERS

FIELD OF THE INVENTION

The present disclosure relates to novel and advantageous storage and dispensing systems. More particularly, the present disclosure relates to novel and advantageous connector assemblies for use with liner-based assemblies, where material may be stored in, shipped in, and dispensed from the liner-based assembly.

BACKGROUND OF THE INVENTION

Numerous manufacturing processes require the use of ultrapure liquids, such as acids, solvents, bases, photoresists, dopants, inorganic, organic, and biological solutions, pharmaceuticals, and radioactive chemicals. Such industries require that the number and size of particles in the ultrapure liquids be controlled to ensure purity. In particular, because ultrapure liquids are used in many aspects of the microelectronic manufacturing process, semiconductor manufacturers have established strict particle concentration specifications for process chemicals and chemical-handling equipment. Such specifications are needed because, should the liquids used during the manufacturing process contain high levels of particles or bubbles, the particles or bubbles may be deposited on solid surfaces of the silicon. This can, in turn, lead to product failure and reduced quality and reliability.

Storage and dispensing systems that are used to store, ship, and dispense the liquids described above, as well as other liquid-based contents, typically include a container of some kind, and/or a liner, a cap that may be used to seal and protect the contents of the storage system when the contents are not being dispensed, and a connector that may be used to dispense the contents from the container. The connector that is used during dispense is typically uniquely configured to provide a particular type of dispense. Accordingly, the connector that is used during dispense will have an effect on several aspects of the dispense, for example, whether the dispense is a pump or pressure dispense, what the flow rate of dispense may be, and/or how much residue may remain in a liner or container after dispense. In this regard, there is a need for a connector that increases the flow-rate during dispense and/or increases the total amount of material that may be dispensed.

BRIEF SUMMARY OF THE INVENTION

The present disclosure relates to novel and advantageous connector assemblies for use with a liner-based assembly. In one embodiment, a connector assembly for use with a liner-based assembly can include a pressure port, a dispense port, a headspace removal port, and a locking mechanism. The pressure port can be adapted for connection to a pressure source. The dispense port can be adapted for fluid communication with a source of material to be dispensed from the liner-based assembly. The headspace removal port may be configured for removing a gas from the liner-based assembly. The locking mechanism may be used for locking the connector to the liner-based assembly when contents therein are under pressure. In some embodiments, the dispense port and headspace removal port may be operably coupled providing a flow path for recirculation of the contents within a liner of the liner-based assembly.

In other embodiments, the present disclosure relates to a method for pump dispensing the contents of a liner-based assembly. The method may include connecting a connector to the liner-based assembly. The connector can include a pressure port adapted for connection to a pressure source, a dispense port adapted for fluid communication with a source of material to be dispensed within the liner-based assembly, and a headspace removal port configured for removing a gas from the liner-based assembly. The method can further include removing headspace gas contained in a liner of the liner-based assembly through the headspace removal port, for example, using pressure-assist, and using a pump to dispense the source of material through the dispense port. In some embodiments, with the pressure port plugged, the dispense port and headspace removal port may be operably coupled providing a flow path for recirculation of the contents within a liner of the liner-based assembly.

In still other embodiments, the present disclosure relates to a method for dispensing the contents of a liner-based assembly. The method can include connecting a connector to the liner-based assembly. The connector can include a pressure port adapted for connection to a pressure source, a dispense port adapted for fluid communication with a source of material to be dispensed within the liner-based assembly, and a headspace removal port configured for removing a gas from the liner-based assembly. The method can also include removing headspace gas contained in a liner of the liner-based assembly through the headspace removal port. The contents may be dispensed using pressure dispense or pressure-assisted pump dispense techniques. In one particular embodiment, the present disclosure relates to a method for dispensing the contents of a liner-based assembly including connecting a connector to the liner-based assembly, the connector having a dispense port and a dip tube extending at least partially into an interior space of the liner-based assembly, the dip tube having a diameter of at least about one inch and being coupled to the dispense port, and dispensing contents of the interior space of the liner through the dispense port.

In still other embodiments, the present disclosure relates to a connector for use with a liner-based assembly. The connector may include a dispense port and a dip tube extending at least partially into an interior space of the liner-based assembly, the dip tube having a diameter of at least about one inch and being coupled to the dispense port for dispensing contents of the liner-based assembly through the dispense port. In variations thereof, the connector may further include a headspace removal port, and in some embodiments, the dispense port and headspace removal port may be operably coupled providing a flow path for recirculation of the contents of the liner-based assembly. A locking mechanism may be provided and may include one or more locking cylinders configured to engage when a threshold pressure is reached in the liner-based assembly and to not engage when the pressure in the liner-based assembly is below the threshold pressure. The connector may be configured for indirect pressure dispense whereby a pressurized gas or a pressurized fluid is introduced into an annular space between a liner and an overpack of the liner-based assembly, the force of the pressurized gas or pressurized fluid causing the liner to collapse upon itself and force the contents of the liner out through the dispense port. Additionally, the dip tube may be configured to extend only partially into the interior of the liner-based assembly, sometimes referred to as a short probe or a stubby probe.

In yet other embodiments, the present disclosure relates to a system for dispensing the contents of a liner-based assembly. The system may include an overpack, a liner including an interior space for holding contents, the liner being disposed inside of the overpack, and a connector comprising a locking mechanism for locking the connector to at least one of the liner and the overpack when the contents of the liner are under pressure. The connector may further include a diptube extending at least partially into the interior space of the liner, the diptube having a diameter of at least about one inch. In some cases, the diptube may only partially extend into the interior of the liner. The liner may be collapsible under pressure applied to the space between the liner and overpack to dispense the contents of the liner through the diptube.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

Figure 1:
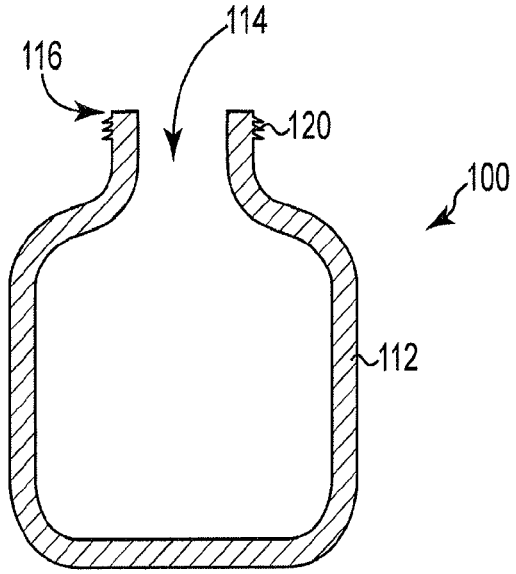
FIG. 1 is a cross-sectional view of a container of the present disclosure, according to one embodiment.

The present disclosure relates to novel and advantageous storage and dispensing systems. More particularly, the present disclosure relates to novel and advantageous connector assemblies for use with storage devices and methods for storing, shipping, and/or dispensing the contents of a container of the present disclosure. Furthermore, the present disclosure relates to novel and advantageous connector assemblies that increase the flow-rate during dispense and/or increase the total amount of material that may be dispensed.

In particular, one embodiment of the present disclosure includes a connector for a storage and dispensing system that may provide a high-flow rate during dispense and/or allow a greater percentage of the contents of a liner to be dispensed than conventional connectors. Embodiments of a high-flow and low-residual connector (referred to hereinafter as a "high-flow connector") described herein may be used with storage and dispensing containers that may hold up to approximately 2000 liters, preferably up to approximately 200 liters. In some embodiments, the dispensing containers may hold up to approximately 20 liters. In still further embodiments, the dispensing containers may hold approximately 1 to 5 liters. It will be appreciated that the referenced container sizes are illustrative only and that any of the high-flow connectors of the present disclosure may be readily adapted for use with a wide variety of sized and shaped dispensing containers.

Example uses of the containers and container systems disclosed herein may include, but are not limited to, transporting and dispensing acids, solvents, bases, photoresists, chemicals and materials for OLEDs, such as phosphorescent dopants that emit green light, for example, ink jet inks, slurries, detergents and cleaning formulations, dopants, inorganic, organic, metalorganics, TEOS, and biological solutions, DNA and RNA solvents and reagents, pharmaceuticals, hazardous waste, radioactive chemicals, and nanomaterials, including for example, fullerenes, inorganic nanoparticles, sol-gels, and other ceramics, and liquid crystals, such as but not limited to 4-methoxylbenzylidene-4'-butylaniline (MBBA) or 4-cyanobenzylidene-4'-n-octyloxyanaline (CBOOA). However, such containers and container systems may further be used in other industries and for transporting and dispensing other products such as, but not limited to, coatings, paints, polyurethanes, food, soft drinks, cooking oils, agrochemicals, industrial chemicals, cosmetic chemicals (for example, foundations, bases, and creams), petroleum and lubricants, adhesives (for example, but not limited to epoxies, adhesive epoxies, epoxy and polyurethane coloring pigments, polyurethane cast resins, cyanoacrylate and anaerobic adhesives, reactive synthetic adhesives including, but not limited to, resorcinol, polyurethane, epoxy and/or cyanoacrylate), sealants, health and oral hygiene products, and toiletry products, etc. Those skilled in the art will recognize the benefits of such storage and dispense systems and methods of their use, and therefore will recognize the suitability of the various embodiments of high-flow connectors, as described herein, as used with a storage and dispense system to various industries and for the transportation and dispense of various products.

For example, a high-flow connector of the present disclosure may be used with, but is not limited to use with, a container 100, shown in FIG. 1. The container 100 may include a container wall 112, an interior cavity 114, and a mouth 116. The outside of the mouth 116 of the container 100 may have threads 120 that may couple with complementary threads on a high-flow connector assembly. However, it will be appreciated that the mouth 116 of the container may have any alternative or additional means for coupling to a high-flow connector such as a snap-fit mechanism or any other suitable mechanism or combination of mechanisms for coupling. The container 100 may be plastic, glass, metal, or any other suitable material or combination of materials. The container may be of any suitable shape or configuration, such as, but not limited to, a bottle, a can, a drum, etc. For instance, by way of example and not limitation, in one embodiment the container 100 may be a glass bottle. In another embodiment, the container 100 may be what is typically referred to as a metal can. The container 100 may be manufactured using any process, such as injection blow molding, injection stretch blow molding, extrusion, etc. The container 100 may be manufactured as a single component or may be a combination of multiple components. In some embodiments, the container 100 may have a relatively simplistic design with a generally smooth container wall 112 and interior cavity 114. In other embodiments, the container 100 may have a relatively complicated design including, for example and not limited to, indentations, protrusions, and/or varying wall 112 thickness. Such a container may be substantially similar to the containers disclosed in U.S. Application No. 61/251,430, entitled, "Material Storage and Dispensing System and Method With Degassing Assembly," filed Oct. 14, 2009, now International PCT Patent Application No. PCT/US 10/51786, filed Oct. 7, 2010, each of which is hereby incorporated herein by reference in its entirety. Similarly, the following patents and patent applications disclose containers that may be used in accordance with the present disclosure: International PCT Patent Application No. PCT/US10/41629, titled "Substantially Rigid Collapsible Liner and Flexible Gusseted or Non-Gusseted Liners and Methods of Manufacturing the Same and Methods for Limiting Choke-Off in Liners," filed on Jul. 9, 2010; International PCT Patent Appl. No. PCT/US11/055,558, titled "Substantially Rigid Collapsible Liner, Container and/or Liner for Replacing Glass Bottles, and Enhanced Flexible Liners," filed Oct. 10, 2011; U.S. patent application Ser. No. 11/915,996, titled "Fluid Storage and Dispensing Systems and Processes," which was filed Jun. 5, 2006; and International PCT Patent Appl. No. PCT/US/055560, titled, "Nested Blow Molded Liner and Overpack and Methods of Making Same," filed Oct. 10, 2011, each of which are hereby incorporated herein by reference in their entirety.

Figure 2:
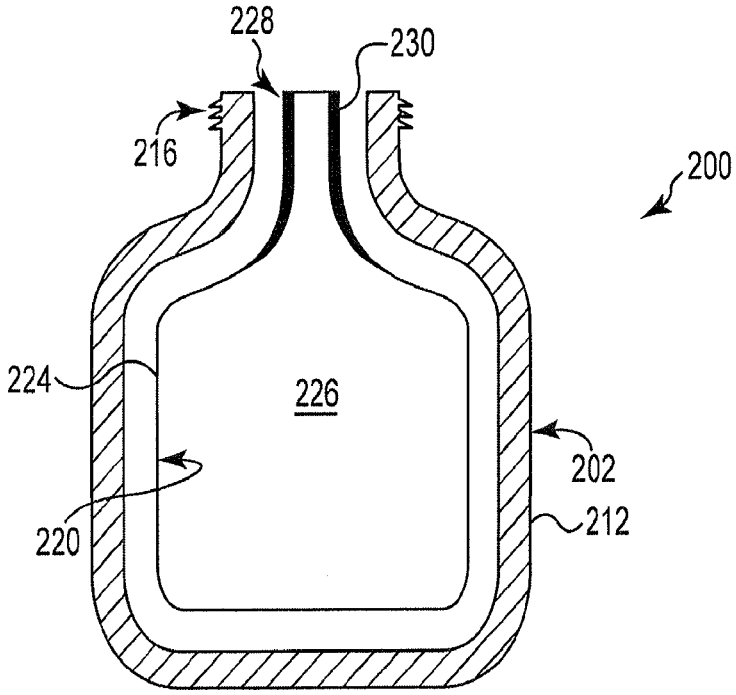
FIG. 2 is a cross-sectional view of a container system, including a container and a liner, according to one embodiment of the present disclosure.

In other embodiments, as shown in FIG. 2, a high-flow connector of the present disclosure may be used with, but is not limited to use with, a container system 200 that may include, in some embodiments, a container or overpack 202 and a liner 220. The overpack 202 may have an overpack wall 212 and a mouth 216, similar to the container described above and shown in FIG. 1. Also similar to the container described above, the overpack 202 may be plastic, glass, metal, or any other suitable material or combination of materials. The overpack may be of any suitable shape or configuration, such as, but not limited to, a bottle, a can, a drum, etc. The liner 220 may include a liner wall 224, an interior cavity 226, and a mouth 228. The liner 220, in one embodiment, may be dimensioned and shaped to substantially conform to the interior of the container or overpack 202. As such, the liner 220 may have a relatively simplistic design with a generally smooth outer surface, or the liner 220 may have a relatively complicated design including, for example but not limited to, indentations and protrusions. The liner 220 may have a relatively thin liner wall 224, as compared to the thickness of the overpack wall 212. The liner 220 may be collapsible such that the liner wall 224 may be readily collapsed, such as by vacuum through the mouth 228 or by pressure between the liner wall 224 and overpack wall 212.

The liner 220, in a further embodiment, may have a shape, when inflated or filled, that is different from, but complimentary with, the shape of the overpack 202 such that it may be disposed therein. In one embodiment, the liner 220 may also be removable or removably attached to the interior of the overpack wall 212. The liner 220 may provide a barrier, such as a gas barrier, against drive gas migration from the space between the liner wall 224 and the overpack wall 212. In some embodiments, the liner 220 may be manufactured using one or more polymers, including plastics, nylons, EVOH, polyolefins, or other natural or synthetic polymers. In a further embodiment, the liner 220 may be manufactured using a fluoropolymer, such as but not limited to, polychlorotrifluoroethylene (PCTFE), polytetrafluoroethylene (PTFE), fluorinated ethylene propylene (FEP), perfluoroalkoxy (PFA), polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), and/or polypropylene (PP). In some embodiments, the liner 220 may comprise multiple layers. The multiple layers may comprise one or more different polymers or other suitable materials. The mouth 228 of the liner 220 may also have a fitment portion 230. The fitment portion 230 may be made of the same or different material than the rest of the liner 220 and may be harder, more resilient, and/or less flexible than the rest of the liner 220. International PCT Application No. PCT/US2008/085264, entitled, "Blow Molded Liner for Overpack Container and Method of Manufacturing the Same," filed Dec. 2, 2008, for which U.S. national stage application Ser. No. 12/745,605 was filed Jun. 1, 2010; International PCT Patent Application No. PCT/US10/41629, titled "Substantially Rigid Collapsible Liner and Flexible Gusseted or Non-Gusseted Liners and Methods of Manufacturing the Same and Methods for Limiting Choke-Off in Liners," filed on Jul. 9, 2010; International PCT Appl. No. PCT/US11/055,558, titled "Substantially Rigid Collapsible Liner, Container and/or Liner for Replacing Glass Bottles, and Enhanced Flexible Liners," filed Oct. 10, 2011; and U.S. patent application Ser. No. 11/915,996, titled "Fluid Storage and Dispensing Systems and Processes," which was filed Jun. 5, 2006, which are all either newly or previously hereby incorporated herein by reference in their entirety, disclose liners that may be used in accordance with the present disclosure.

While various containers and container systems, as described above, may be used with the various embodiments of high-flow connectors of the present disclosure, such high-flow connectors described herein may be particularly useful with bag-in-can assemblies and/or bag-in-drum assemblies having sizes up to approximately 200 liters, for example. As will be described below, the high-flow connectors may be used with pump dispense, pressure-assisted pump dispense, direct pressure dispense, and/or indirect pressure dispense applications. In general, during pump dispense, a dip tube may extend into the liner up to substantially the entire length of the liner, and the contents of the liner may be pumped out of the liner via the dip tube. Embodiments of liner-based systems using pump dispense may or may not include both a container or overpack and a liner. In pressure-assisted pump dispense, the contents of the liner may be pumped out of the liner via a dip tube, for example, but additionally, a gas or liquid may be introduced into the space between the liner and the overpack to assist the collapse of the liner and thereby remove headspace gas and/or facilitate dispense. Pressure dispense applications may be direct or indirect. Direct pressure dispense may generally involve introducing gas from a pressure source into the liner above the gas-liquid interface, for example, which may directly contact and force the contents of the liner out of the dispense port. Embodiments using direct pressure dispense may or may not include both a container or overpack and a liner. In general, during indirect pressure dispense, an external source of pressure can be used to pressurize the space between the liner and the overpack (also referred to herein as the annular space) via the pressure port. The resulting pressure on the liner can cause the liner to collapse upon itself and expel the contents of the liner through the dispense port.

Figure 3:
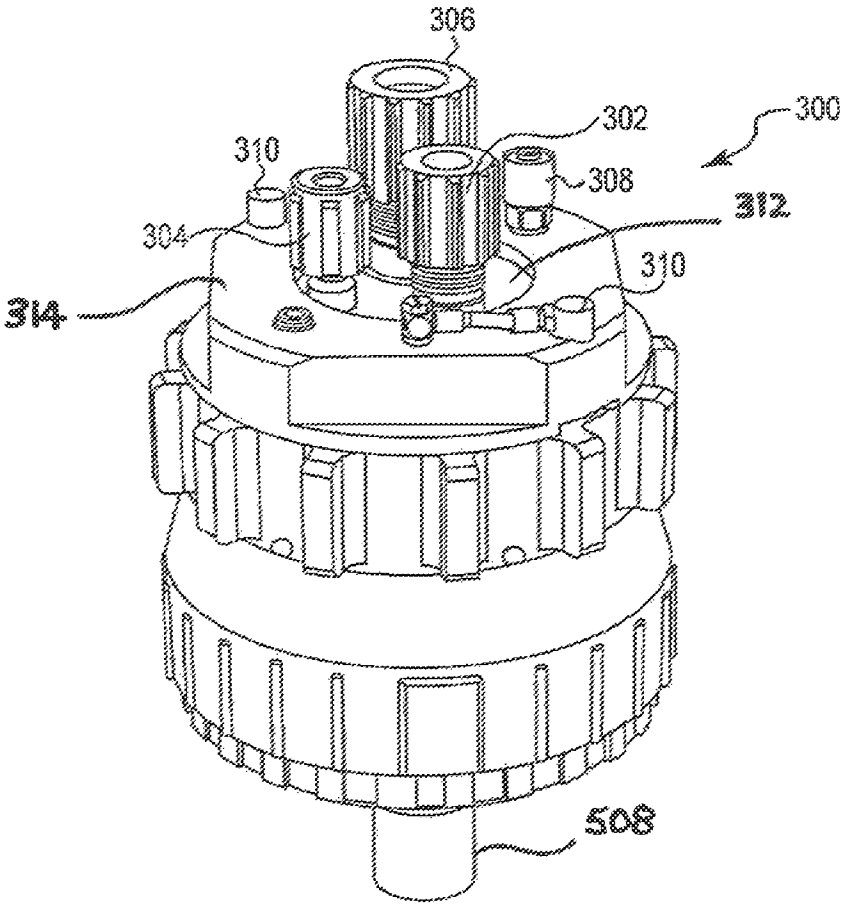
FIG. 3 is a perspective view of a connector according to one embodiment of the present disclosure.
Figure 4:
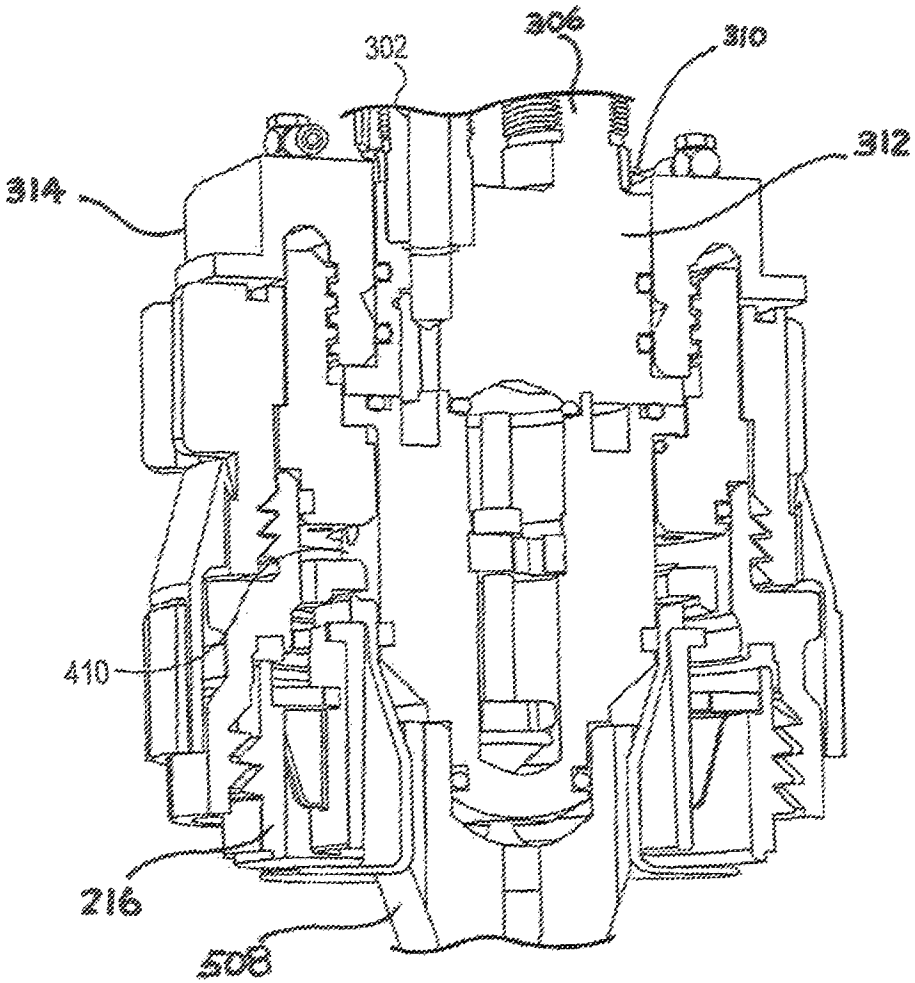
FIG. 4 is a cross-sectional view of a connector according to one embodiment of the present disclosure.
Figure 5:
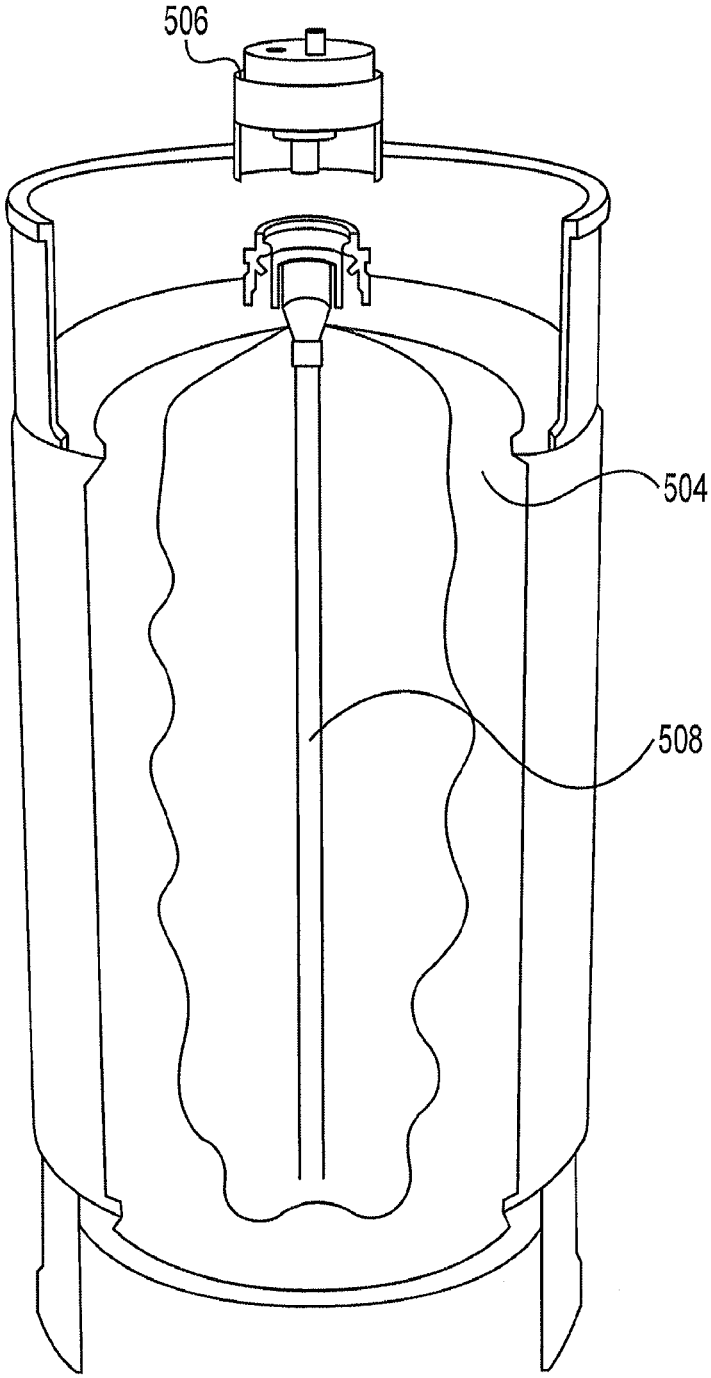
FIG. 5 is a cut-away view of a connector in use with a liner-based assembly according to one embodiment of the present disclosure.

As shown in FIG. 3, in one embodiment a high-flow connector 300 includes a body portion 312 surrounded by a threaded flange portion 314 and coupled to a dip tube 508 (FIG. 5), the threaded flange portion 314 being adapted to secure the high flow connector 300 to the mouth 216 of the overpack 202. The high flow connector 300 may include a pressure port 302, a dispense port 306, one or more locking mechanisms or cylinders 310, a pressure relief valve 308, and a headspace removal port 304. The pressure port 302 may be configured to attach to a source of pressure, which may be either gas or liquid, for example. Generally, the pressure port 302 may direct the external source of pressure to flow through the connector and into the annular space between an overpack and a liner within the overpack in embodiments using indirect pressure dispense or pressure-assisted pump dispense, for example. The liner in such an assembly may be any of the liners discussed or incorporated by reference herein, for example, but not limited to, a flexible liner, or a rigid collapsible liner. Because the overpack is substantially rigid, or at least more rigid than the liner, the pressure that is introduced into the annular space between the liner and the overpack will generally force the liner to collapse in upon itself, thereby forcing the contents of the liner out of the liner and through the connector dispense port 306 for dispense. As may be seen in FIG. 4, the pressure port may have an outlet 410 that directs the source of pressure into the space between the liner and the overpack.

With reference back to FIG. 3, the connector 300 may also include one or more locking cylinders 310. In some embodiments the contents may be removed from the liner by using pressure as was generally described above to further collapse the liner, thereby expelling the contents of the liner out through the dispense port 306. Because some embodiments of the present disclosure include a high-flow connector used in combination with a relatively large diameter dip tube, a greater amount of pressure may be required to dispense the contents of the liner at a desired rate. Accordingly, the locking cylinders 310 may help to ensure that the connector cannot be removed from the liner and/or overpack, or may otherwise make it difficult for the connector to be removed, while the assembly is under pressure so as to eliminate or significantly reduce the risks associated therewith, such as the safety risks, e.g., harm to users, the risk of damaging the overpack, and/or the risk of losing the material stored in the liner. In one embodiment, the locking cylinders 310 may engage when a certain threshold pressure within the overpack is reached or exceeded during a pressure dispense application. The locking cylinders 310 may become disengaged when the pressure in the overpack is no longer above the threshold pressure. For example, in one embodiment, once the space in between the liner and the overpack reaches above about 4 psi, for example, the locking cylinders 310 may be engaged and lock the connector so that it may generally not be removed from the overpack while under pressure. Once the pressure is lowered to below about 4 psi, for example, the locking cylinders 310 may be disengaged. It will be understood that any other locking mechanism may be used to keep the connector securely attached to the overpack and liner during pressurized dispense.

The pressure release valve 308 may be used to release pressure in cases where the pressure in between the liner and the overpack becomes higher than is desired. For example, if only about 20 psi or less is desired between the liner and the overpack, the pressure may be vented through the pressure release valve 308 if the pressure between the liner and the overpack exceeds about 20 psi. While specific pressures have been described, it will be understood that any suitable pressure may be selected depending on, for example, the type of liner and/or overpack being used, and/or the type of dispense used, and/or the kind of contents stored in the liner.

The contents of the liner may be expelled from the liner out through a dip tube, in some embodiments. As may be seen in FIG. 5, a dip tube 508 may extend into the liner 504 and attach to, or be permanently affixed to, the connector 506 such that the contents of the liner 504 may be directed from the liner 504 out through the dispense port. The dip tube 508 may extend any suitable length into the liner, such as ½ the distance into the container, or the dip tube 508 may extend less than or more than ½ the distance into the container. For example, in some embodiments, which may be particularly useful for pump dispense applications, the dip tube 508 may extend substantially the entire length of the liner 504. In other embodiments, for example but not limited to those for use with pressure dispense applications, the dip tube 508 may extend only a relatively short distance into the liner, which in some cases may be referred to as a "stubby probe." Examples of "stubby probes" that may be used with the present disclosure may be those of ATMI of Danbury, Conn., or those disclosed in PCT Application No. PCT/US07/70911, entitled "Liquid Dispensing Systems Encompassing Gas," with an international filing date of Jun. 11, 2007, which is hereby incorporated by reference herein in its entirety. In some embodiments, the dip tube 508 may have about a one inch diameter, which may significantly increase the flow rate of dispense. In other embodiments, the diameter of the dip tube 508 may be less than or greater than one inch, depending on the desired dispense flow rate or other system specifications, for example. The dip tube may be made of plastic, rubber, glass, or any other suitable material, or combination of materials.

As indicated above, the connector of the present disclosure, in some embodiments, may also include a headspace removal port 304. Generally, the expression "headspace," as used herein, may refer to the gas space in the liner that may rise to the top of the liner, above the contents stored in the liner. If all, or substantially all, of the headspace gas is removed, then generally the only remaining sources of gas bubbles, if any, would be any folds in the liner. It may be advantageous to remove the headspace gas prior to pressure dispense and pressure-assisted pump dispense, for example. The headspace removal port 304 may facilitate removal of the headspace gas in a liner or container.

Figure 6:
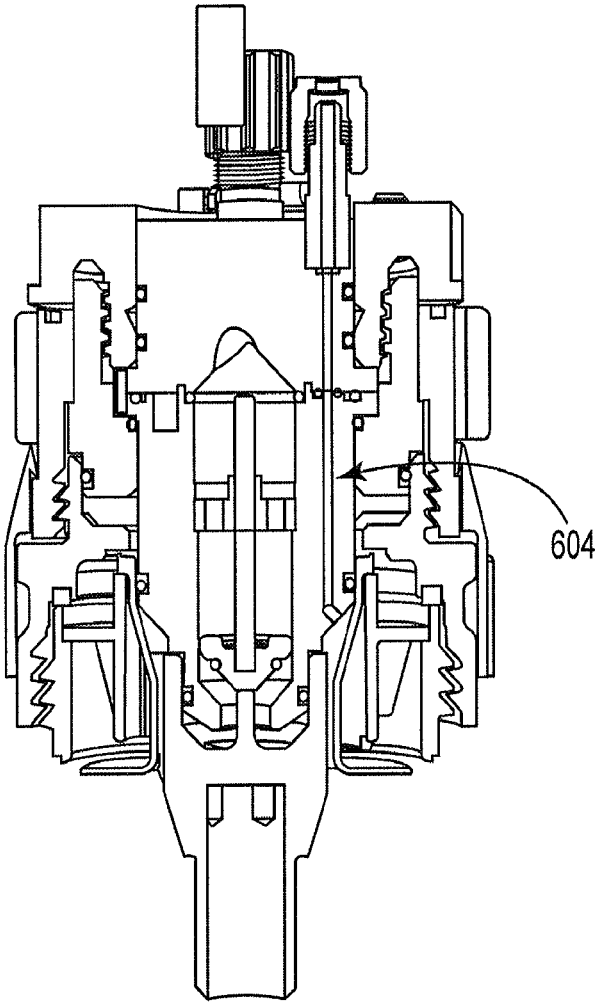
FIG. 6 is cross-sectional view of a connector according to one embodiment of the present disclosure.

For example, as shown in FIG. 6, a headspace removal port 604 may include a tube or canal that leads into the liner. Accordingly, the headspace in the liner may be removed or reduced by first pressurizing the annular space between the liner and the overpack via the pressure port so that the liner begins to collapse, thereby forcing any excess gas out of the liner through the headspace removal port 604. In some embodiments, it may take no more than about 3 psi to remove the headspace. Once the headspace gas is substantially removed, the contents of the liner may then be dispensed through the dispense port by either pressure dispense or pump dispense.

As was discussed previously, many materials that may be stored in liner-based assemblies may be high-purity liquids that must maintain a certain high purity level during dispense. Accordingly, in some conventional systems, one method of determining when to stop dispensing the contents of the liner is often referred to as "first-bubble detect" technology. In such a method, as the contents are dispensed from the liner, the contents of the liner may be screened or otherwise evaluated to detect the presence of bubbles. When a specific amount of bubbles are detected, indicating a certain level of contaminating gas in the contents, the dispensing is halted and the liner is generally considered exhausted. In dispensing processes that use such a system, it is typical that the amount of residual material that goes to waste once dispense is halted in this manner can be around 3-10%; that is, for a 200 L liner, for example, as much as 6-20 L of residual material are left in the liner and goes to waste. This can be significantly costly when dealing with expensive high purity contents.

In this regard, eliminating the excess gas, such as headspace gas, that may be trapped in the liner prior to dispense may allow a greater, and in some cases a substantially greater, amount of uncontaminated material to be dispensed because there would be a lower likelihood of bubble contamination from the excess gas. Thus, in one embodiment of the present disclosure, the amount of residual, i.e., unusable material, left in the liner may be reduced and in some cases significantly reduced by removing the headspace gas in the liner prior to dispensing the contents of the liner. In some embodiments of the present disclosure, the amount of residual material left can be reduced to as low as or less than about 1%; for example, in a 200 L liner, the residual amount may be reduced to 1.5 L or less. Because substantially no bubbles may remain in the system in embodiments removing the headspace gas, an alternate form of empty-detect may be used. Any suitable method or combination of methods of empty-detect may be used, for example, but not limited to monitoring the droop of liquid outlet pressure that occurs when the liner nears empty. In embodiments using such a method of empty-detect, the dispense may terminate when the liquid outlet pressure reaches a desired level.

In an additional embodiment as discussed above, pump dispense may be pressure-assisted to help uniformly collapse the liner and/or improve dispensability. Particularly, the annular space between the liner and the overpack may be kept pressurized during dispense so as to assist in uniform collapsing of the liner during pump dispense, which can help improve dispensability of a pump dispense system. Such assistance for pump dispense systems may be referred to herein as one embodiment of pressure-assisted pump dispense. In some embodiments, only about 3 psi or less may be required to assist pump dispense. However, it is recognized that any suitable amount of pressurization may be used depending on the system and application.

In some embodiments and with reference to FIG. 3, the pressure port 302 and/or the headspace removal port 304 may be removed and replaced with a plug, for example, or different size threading in order to make the connector adaptable for use with different dispense methods. Each of the removable ports may have a face seal, for example, and may be secured by any known means, for example, using one or more dowel pins, threading, snap-fit, or any other suitable mechanism or combination of mechanisms. In still other embodiments, the headspace removal port 304 may be capped or it may be left open as a vent, such as for cases where the liner does not collapse, in some direct pressure dispense or pump dispense applications, for example.

In yet another embodiment, the connector may permit recirculation of the contents of the liner, which may be particularly useful for the recirculation of pressure sensitive or viscous materials. As stated above, the storage and dispensing systems of the present disclosure may be used for transporting and dispensing acids, solvents, bases, photoresists, dopants, inorganic, organic, and biological solutions, pharmaceuticals, and radioactive chemicals. Some of these types of materials may require recirculation while not being dispensed, otherwise they may become stale and unusable. As some of these materials can be very expensive, it can be desirable to keep the contents from becoming stale. Accordingly, in one embodiment, the connector may be used to recirculate the contents of the liner. Although not necessary for all types of contents, in one embodiment, the headspace may be removed as described above. After the headspace is removed, the headspace removal port may be used as a recirculation port. Accordingly, a recirculation flow path may be created from the interior of the liner, through the dispense port, through any other apparatus that may be used in the recirculation process, such as but not limited to a recirculation pump, and then back to the interior of the liner through the headspace removal port. In further embodiments, the liner may be maintained at a pressurized state using the pressure port to introduce a pressurizing gas, as described above. In some embodiments, the connector may also have a mechanical check valve that may prevent the stored material from leaking and/or dripping when the connector is removed from the liner and/or overpack.

Some embodiments of the container systems described above may also include features for helping prevent or limit choke-off. Generally speaking, choke-off may be described as what occurs when a liner ultimately collapses on itself, or a structure internal to the liner, to form a choke point disposed above a substantial amount of liquid. When choke-off occurs, it may preclude complete utilization of the liquid disposed within the liner, which can be a significant problem, as specialty chemical reagents utilized in industrial processes such as the manufacture of microelectronic device products as well as many materials used in the biotechnology and/or pharmaceutical industry, for example, can be very expensive. A variety of ways of preventing or handling choke-off are described in PCT Application Number PCT/US08/52506, entitled, "Prevention Of Liner Choke-off In Liner-based Pressure Dispensation System," with an international filing date of Jan. 30, 2008, which is hereby incorporated herein by reference in its entirety. Additional ways of preventing or handling choke-off are described in International PCT Appl. No. PCT/US11/055,558, titled "Substantially Rigid Collapsible Liner, Container and/or Liner for Replacing Glass Bottles, and Enhanced Flexible Liners," filed Oct. 10, 2011, which was previously incorporated herein by reference in its entirety.

In some embodiments, the container systems may include level sensing features or sensors. Such level sensing features or sensors may use visual, electronic, ultrasonic, or other suitable mechanisms for identifying, indicating, or determining the level of the contents stored in the container systems. For example, in one embodiment, the container systems or a portion thereof may be made from a substantially translucent or transparent material that may be used to view the level of the contents stored therein.

In further embodiments, flow metering technology may be integrated into or operably coupled with the connectors for a direct measurement of material being delivered from the packaging system to a down stream process. A direct measurement of the material being delivered could provide the end user with data which may help ensure process repeatability or reproducibility. In one embodiment, the flow meter may provide an analog or digital readout of the material flow. The flow meter, or other component of the system, can take the characteristics of the material (including but not limited to viscosity and concentration) and other flow parameters into consideration to provide an accurate flow measurement. Additionally, or alternatively, the flow meter can be configured to work with, and accurately measure, a specific material stored and dispensed from the container system. In one embodiment, the inlet pressure can be cycled, or adjusted, to maintain a substantially constant outlet pressure or flow rate.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A connector for use with a liner-based assembly, the connector comprising:

a body portion defining a dispense port;

a threaded flange portion surrounding the body portion and adapted to secure the connector to the liner-based assembly;

a dip tube extending at least partially into an interior space of the liner-based assembly, the dip tube having a diameter of at least about one inch and being coupled to the dispense port for dispensing contents of the liner-based assembly through the dispense port; and one or more locking cylinders mounted to the threaded flange portion and configured to engage the liner-based assembly when a threshold pressure is reached in the liner-based assembly, and to disengage the liner-based assembly when the pressure in the liner-based assembly is below the threshold pressure.

2. The connector of claim 1, further configured to support a pressure in the liner-based assembly of less than about 20 psi during dispense of the contents of the liner-based assembly.

3. The connector of claim 1, further comprising a headspace removal port, wherein the dispense port and headspace removal port are operably coupled providing a flow path for recirculation of the contents of the liner-based assembly.

4. The connector of claim 1, wherein the connector is configured for indirect pressure dispense whereby a pressurized gas or a pressurized fluid is introduced into an annular space between a liner and an overpack of the liner-based assembly, the force of the pressurized gas or pressurized fluid causing the liner to collapse upon itself and force the contents of the liner out through the dispense port.

5. The connector of claim 4, wherein the dip tube is configured to extend only partially into the interior of the liner-based assembly.

6. The connector of claim 1, further comprising a cap that is coupled to a headspace removal port.

7. The connector of claim 1, further comprising a pressure release valve configured to release pressure within the liner-based system if the pressure reaches a predetermined level.

8. A method for dispensing contents of a liner-based assembly, the method comprising:

connecting a connector to the liner-based assembly, the connector comprising:

a body portion defining a dispense port, a threaded flange portion surrounding the body portion adapted to secure the connector to the liner-based assembly:, a dip tube extending at least partially into an interior space of the liner-based assembly, the dip tube being coupled to the dispense port, and at least one locking cylinder mounted to the threaded flange portion and configured to lock the connector to the liner-based assembly when a pressure within the overpack is greater than or equal to a threshold pressure; and dispensing contents of the interior space of the liner through the dispense port.

9. The method of claim 8, further comprising maintaining a pressure in the liner-based assembly of less than about 20 psi during dispense of the contents of the liner-based assembly.

10. The method of claim 8, wherein the connector further comprises:

a pressure port adapted for connection to a pressure source; and a headspace removal port configured for removing a gas from the liner-based assembly.

11. The method of claim 10, further comprising removing headspace gas contained in a liner of the liner-based assembly through the headspace removal port by introducing pressurized gas or pressurized liquid from the pressure source into an annular space of the liner-based assembly.

12. The method of claim 11, further comprising using pressure dispense to dispense the contents of the liner-based assembly through the dispense port.

13. The method of claim 12, wherein the dip tube extends only partially into an interior space of the liner-based assembly.

14. The method of claim 11, further comprising using pressure-assisted pump dispense to dispense the contents of the liner-based assembly through the dispense port.

15. A system for dispensing contents of a liner-based assembly, the system comprising:

an overpack;

a liner including an interior space for holding the contents, the liner being disposed inside of the overpack; and a connector comprising a body portion, a threaded flange portion surrounding the body portion and adapted to secure the connector to the liner-based assembly, and a locking cylinder mounted to the threaded flange portion, the locking cylinder configured to lock the connector to at least one of the liner and the overpack when a pressure within the overpack is greater than or equal to a threshold pressure.

16. The system of claim 15, wherein the connector is configured to support a pressure in the liner-based assembly of less than about 20 psi during dispense of the contents of the liner-based assembly.

17. The system of claim 15, wherein the connector further comprises a diptube extending at least partially into the interior space of the liner, the diptube having a diameter of at least about one inch.

18. The system of claim 17, wherein the diptube only partially extends into the interior of the liner.

19. The system of claim 18, wherein the liner is collapsible under pressure applied to the space between the liner and overpack to dispense the contents of the liner through the diptube.

* * * * *